US006732684B2

(12) United States Patent
Onohara et al.

(10) Patent No.: US 6,732,684 B2
(45) Date of Patent: May 11, 2004

(54) SOLENOID-TYPE VALVE ACTUATOR FOR INTERNAL COMBUSTION ENGINE

(75) Inventors: Yoshinori Onohara, Saitama-ken (JP); Kouichi Ikoma, Saitama-ken (JP); Yoshitomo Kouno, Saitama-ken (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/027,072

(22) Filed: Dec. 20, 2001

(65) Prior Publication Data

US 2002/0078912 A1 Jun. 27, 2002

(30) Foreign Application Priority Data

Dec. 21, 2000 (JP) ..... 2000-388675

(51) Int. Cl.[7] ..... F01L 9/04
(52) U.S. Cl. ..... 123/90.11
(58) Field of Search ..... 123/90.11; 251/129.01

(56) References Cited

U.S. PATENT DOCUMENTS 3,882,833 A * 5/1975 Longstaff et al. ..... 123/90.11
4,424,780 A * 1/1984 Trucco ..... 123/255
4,794,890 A * 1/1989 Richeson, Jr. ..... 123/90.11
5,022,358 A * 6/1991 Richeson ..... 123/90.12
5,720,242 A * 2/1998 Izuo ..... 123/90.11
6,116,570 A * 9/2000 Bulgatz et al. ..... 251/129.1
6,186,100 B1 * 2/2001 Sawada ..... 123/90.11
6,237,550 B1 * 5/2001 Hatano et al. ..... 123/90.11
6,279,524 B1 * 8/2001 Schebitz ..... 123/90.11
6,304,161 B1 * 10/2001 Schebitz et al. ..... 335/255
6,328,005 B1 * 12/2001 Klausnitzer et al. ..... 123/90.11

FOREIGN PATENT DOCUMENTS

WO WO 9619643 A1 * 6/1996 ..... F01L/9/04

* cited by examiner

*Primary Examiner*—Thomas Denion
*Assistant Examiner*—Ching Chang
(74) *Attorney, Agent, or Firm*—Lahive & Cockfield, LLP; Anthony A. Laurentano

(57) ABSTRACT

There is provided a solenoid-type valve actuator for an internal combustion engine, having an inexpensive and single construction which is capable of maintaining stability of operation of a valve and reducing sliding resistance to the valve at the same time, thereby achieving improved response of the valve and reduced power consumption of electromagnets. The solenoid-type valve actuator electromagnetically opens and closes a valve. Two electromagnets are arranged in a manner opposed to each other with a space therebetween. An armature is arranged between the two electromagnets, for reciprocating motion by energization and deenergization of the two electromagnets. Two shafts project from respective opposite sides of the armature and extend through the two electromagnets, respectively, one of the shafts being connected to the valve. Two shaft guides are arranged in at least one of the two electromagnets in a line along the direction of the reciprocating motion of the armature, for guiding a reciprocating motion of at least one of the two shafts performed according to the reciprocating motion of the armature.

19 Claims, 7 Drawing Sheets

SOLENOID-TYPE VALVE ACTUATOR FOR INTERNAL COMBUSTION ENGINE

BACKGROUND OF THE INVENTION

1. Field of the Invention

This invention relates to a solenoid-type valve actuator for an internal combustion engine, for opening and closing a valve by two electromagnets.

2. Description of the Prior Art

Conventionally, a solenoid-type valve actuator of the above-mentioned kind has been proposed e.g. by Japanese Laid-Open Patent Publication (Kokai) No. 11-126715. The solenoid-type valve actuator, which opens and closes an intake valve, includes an armature arranged between two electromagnets, and upper and lower shafts integrally formed with the armature in a manner extending upward and downward, respectively, through the respective electromagnets. The armature is connected to the intake valve via the lower shaft, and opens and closes the intake valve by performing reciprocating motion caused by energization and deenergization of the two electromagnets. In this reciprocating motion of the armature, each of the shafts reciprocates while being guided by a guide hole formed in a yoke of a corresponding one of the electromagnets.

In the solenoid-type valve actuator constructed as above, however, high machining accuracy is required to form the guide holes for guiding the reciprocating motion of the shafts in the yokes of the respective electromagnets, which results in an increase in manufacturing costs of the valve actuator. Further, it is desirable to reduce sliding resistance between the shafts and the yokes with a view to improving response of the intake valve as well as to reducing power consumption of the electromagnets. To attain the reduction of the sliding resistance, if bearings, for instance, are employed, this results in a further increase in the manufacturing costs of the solenoid-type valve actuator.

SUMMARY OF THE INVENTION

It is an object of the invention to provide a solenoid-type valve actuator for an internal combustion engine, having an inexpensive and simple construction which is capable of maintaining stability of operation of a valve and at the same time reducing sliding resistance exhibited against the operation of the valve, thereby achieving improved response of the valve and reduced power consumption of electromagnets.

To attain the above object, the present invention provides a solenoid-type valve actuator for an internal combustion engine, for electromagnetically opening and closing a valve, comprising:

- two electromagnets arranged in a manner opposed to each other with a space therebetween;
- an armature arranged between the two electromagnets, for reciprocating motion by energization and deenergization of the two electromagnets;
- two shafts projecting from respective opposite sides of the armature and extending through the two electromagnets, respectively, one of the shafts being connected to the valve; and
- two shaft guides arranged in at least one of the two electromagnets in a line along a direction of the reciprocating motion of the armature, for guiding a reciprocating motion of at least one of the two shafts performed according to the reciprocating motion of the armature.

According to this solenoid-type valve actuator for an internal combustion engine, the armature is caused to reciprocate by energization and deenergization of the two electromagnets, whereby the valve is opened and closed by the shaft connected thereto. During this reciprocating motion of the armature, the at least one of the shafts sliding through the electromagnet having the two shaft guides disposed therein performs reciprocating motion while being guided by the two shaft guides. Since the shaft guides are arranged in a line along the direction of the reciprocating motion of the armature, differently from a case in which one shaft is guided by a single shaft guide or in which a yoke is used for guiding a shaft, it is possible to reduce the contact area between the shaft guides and the shaft while maintaining the same total length of the two shaft guides as that of the single shaft guide and that of the yoke. As a result, the shaft can be supported in a radially stable fashion, which makes it possible to maintain stability of the operation of the valve. Further, since the sliding resistance exhibited against the operation of the valve can be reduced, it is possible to improve response of the valve as well as to reduce power consumption of the electromagnets. In addition, it is possible to enhance accuracy in the opening and closing control of the valve. Moreover, compared with the prior art in which a guide hole is formed through a yoke of the electromagnet, the present embodiment can achieve the above advantageous effects by a more inexpensive and simple construction, i.e. simply by arranging the two shaft guides in a line in the direction of the reciprocating motion of the valve.

Preferably, the two shaft guides are arranged in a line along the direction of the reciprocating motion of the armature with a space provided therebetween.

Preferably, at least one of the two shaft guides is formed with a contact surface for contact with the at least one of the two shafts and a non-contact surface.

According to these preferred embodiments, it is possible to reduce the contact area between the shaft guides and the shaft.

More preferably, the two shaft guides are each formed with a contact surface for contact with an associated one of the two shafts, and a non-contact surface, and a ratio of a length of each contact surface in the direction of the reciprocating motion of the armature to a total length of the two shaft guides in the direction of the reciprocating motion is preset to a value of approximately ¼.

According to this preferred embodiment, it is possible to reduce sliding resistance between the shaft and the shaft guide, and at the same time maintain durability of the solenoid-type valve actuator.

The above and other objects, features, and advantages of the invention will become more apparent from the following detailed description taken in conjunction with the accompanying drawings.

DETAILED DESCRIPTION OF PREFERRED EMBODIMENT

Figure 1:
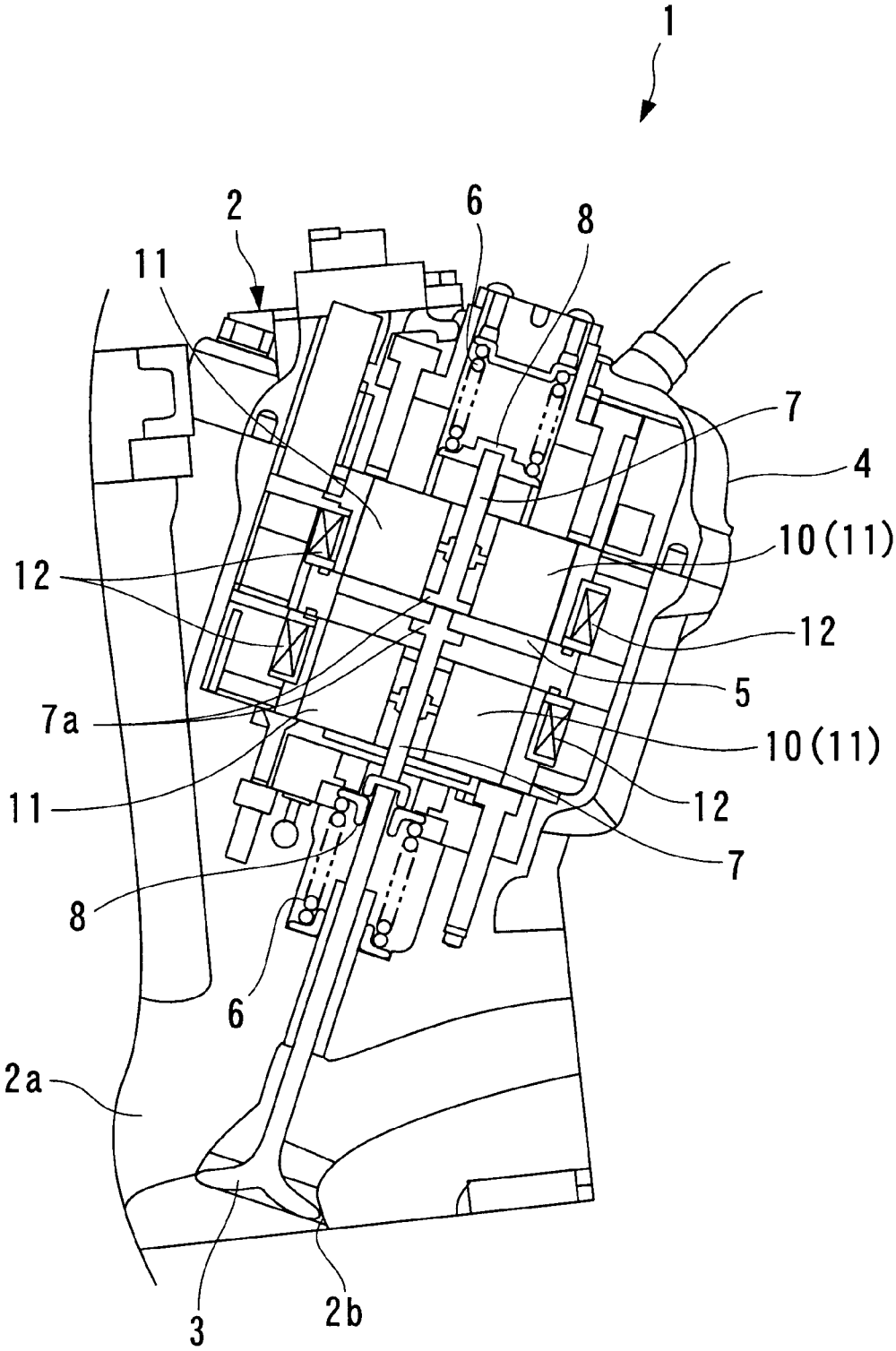
FIG. 1 is a cross-sectional view of a solenoid-type valve actuator for an internal combustion engine, according to an embodiment of the invention.

The invention will now be described in detail with reference to drawings showing an embodiment thereof. FIG. 1 is a cross-sectional view schematically showing a solenoid-type valve actuator for an internal combustion engine, according to the embodiment of the invention. In the figure, hatching for showing cross-sectional portions is omitted for purposes of ease of understanding. As shown in the figure, the solenoid-type valve actuator 1 for an intake valve 3 is mounted in a cylinder head 2*a* of the internal combustion engine (hereinafter referred to as "the engine") 2, partially shown. Further, in the engine 2, there is also mounted a solenoid-type valve actuator, not shown, for an exhaust valve, not shown. During operation of the engine 2, the solenoid-type valve actuator 1 for the intake valve 3 drives the intake valve 3, thereby opening and closing an intake port 2*b* of the engine 2, while the solenoid-type valve actuator for the exhaust valve drives the exhaust valve, thereby opening and closing an exhaust port, not shown, of the same.

The solenoid-type valve actuator 1 includes a casing 4, an armature 5 arranged within the casing 4 such that the armature 5 can reciprocate vertically therein, upper and lower electromagnets 10, 10 each vertically or axially attracting the armature 5 upon excitation thereof, upper and lower coil springs 6, 6 constantly urging the armature 5 in downward and upward directions, respectively, and upper and lower shafts 7, 7 connected to the armature 5.

The armature 5 is a disk formed of a magnetic material (e.g. steel) and has a central portion thereof formed with a through hole extending vertically. The upper and lower shafts 7, 7 are each circular in cross section and formed of a non-magnetic material (e.g. austenitic stainless steel). The upper end of the lower shaft 7 and the lower end of the upper shaft 7 are each fitted in the through hole of the armature 5. The armature 5 is supported in a sandwiched manner by flanges 7*a*, 7*a* formed on the upper and lower shafts 7, 7 at locations close to the lower end and upper end of the respective upper and lower shafts 7, 7.

The upper shaft 7 extends vertically through the upper electromagnet 10. The upper shaft 7 is held in contact with the upper coil spring 6 via a spring-seating member 8 mounted on the upper end of the upper shaft 7. Similarly to the upper shaft 7, the lower shaft 7 extends vertically through the lower electromagnet 10, and the lower end of the lower shaft 7 is connected to the upper end of the intake valve 3. The intake valve 3 is held in contact with the lower coil spring 6 via a spring-seating member 8 mounted on the upper end of the intake valve 3.

Figure 2:
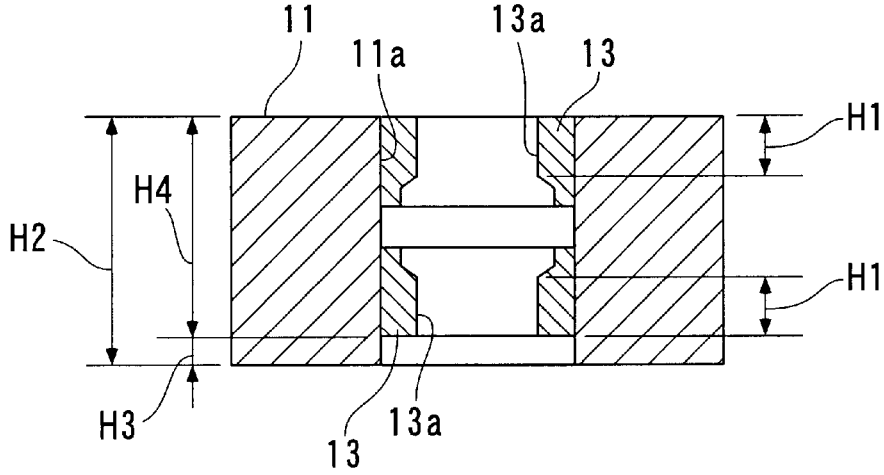
FIG. 2 is a cross-sectional view showing a yoke and shaft guides of the FIG. 1 solenoid-type valve actuator.

The upper and lower electromagnets 10, 10 are identical in construction and arranged in a vertically symmetrical manner with respect to the armature 5 interposed therebetween. In the following, description is given by taking the upper electromagnet 10 as an example. The upper electromagnet 10 includes a yoke 11, and a coil 12 wound around the outer peripheral surface of a bobbin fitted on the yoke 11. As shown in FIG. 2, the yoke 11 has a central portion thereof formed with a through hole 11*a* extending vertically. A pair of upper and lower shaft guides 13, 13 are press-fitted in the through hole 11*a*.

The upper shaft guide 13 is formed of a non-magnetic material (e.g. austenitic stainless steel) and in the form of a short hollow cylinder. The upper shaft guide 13 is formed with an inner through hole extending vertically and has an upper end face thereof arranged flush with that of the yoke 11. The whole portion of the inner through hole except the lower end portion thereof forms a guide hole portion 13*a* which is smaller in diameter than the lower end portion and slightly larger in diameter than the upper shaft 7. The upper shaft 7 is fitted in the guide hole portion 13*a* in a manner axially slidable along the same. The lower shaft guide 13 is arranged in a vertically symmetrical relationship with the upper shaft guide 13, with a space provided therebetween. The whole portion of an inner through hole of the lower shaft guide 13 except the upper end portion thereof also forms a guide hole portion 13*a* in which the upper shaft 7 is fitted in a manner axially slidable along the guide hole portion 13*a*. Further, the lower shaft guide 13 is arranged such that a lower end face thereof is positioned at a location higher than the lower end face of the yoke 11 by a predetermined height H3, to thereby cooperate with the yoke 11 to form a space serving as an indentation for receiving the flange 7*a* of the upper shaft 7.

An effective height H1 (i.e. the height or vertical length of each guide hole portion 13*a*) of each of the shaft guides 13 is set such that the ratio of the effective height H1 to a reference height H4 obtained by subtracting the height H3 of the above indentation from a height H2 of the yoke 11 is equal to a value of approximately ¼. The reason for this will be described hereinafter.

Next, the operation of the solenoid-type valve actuator 1 constructed as above will be described. When neither of the upper and lower electromagnets 10, 10 is excited, the armature 5 is held in its neutral position between the upper and lower electromagnets 10, 10 by the upper and lower coil springs 6, 6. This causes the intake valve 3 to be in a halfway opened/closed position, not shown. The neutral position of the armature 5 is slightly offset toward the lower electromagnet 10 from the precise midpoint between the upper and lower electromagnets 10, 10 so as to hold the intake valve 3 away from a valve seat reliably when the upper and lower electromagnets 10, 10 are in the non-excited state. When the lower electromagnet 10, for instance, is excited in this state, the armature 5 is attracted by the lower electromagnet 10, whereby the armature 5 is moved downward against the urging force of the lower coil spring 6 to a position, not shown, where it is brought into abutment with the yoke 11 of the lower electromagnet 10. In accordance with this movement of the armature 5, the upper and lower shafts 7 and 7 slide downward in a manner guided by the respective upper and lower pairs of shaft guides 13, 13. This causes the intake valve 3 to open the intake port 2*b*.

Subsequently, when the lower electromagnet 10 is becomes non-excited, the armature 5 is moved upward by the urging force of the lower coil spring 6. Then, when the upper electromagnet 10 is excited in a predetermined timing, the armature 5 is attracted by the upper electromagnet 10, whereby the armature 5 is moved upward against the urging force of the upper coil spring 6 to a position where it is brought into abutment with the yoke 11 of the upper electromagnet 10 (see FIG. 1). This upward movement of the armature 5 causes the intake valve 3 to close the intake port 2*b*. Then, after the upper electromagnet 10 becomes non-excited, the lower electromagnet 10 is excited in a predetermined timing to cause the intake valve 3 to open the intake port 2*b*, similarly to the case described above. By repeatedly carrying out the above operations, the armature 5 is caused to vertically reciprocate between the upper and lower electromagnets 10, 10, thereby opening and closing the intake valve 3.

Figure 3:
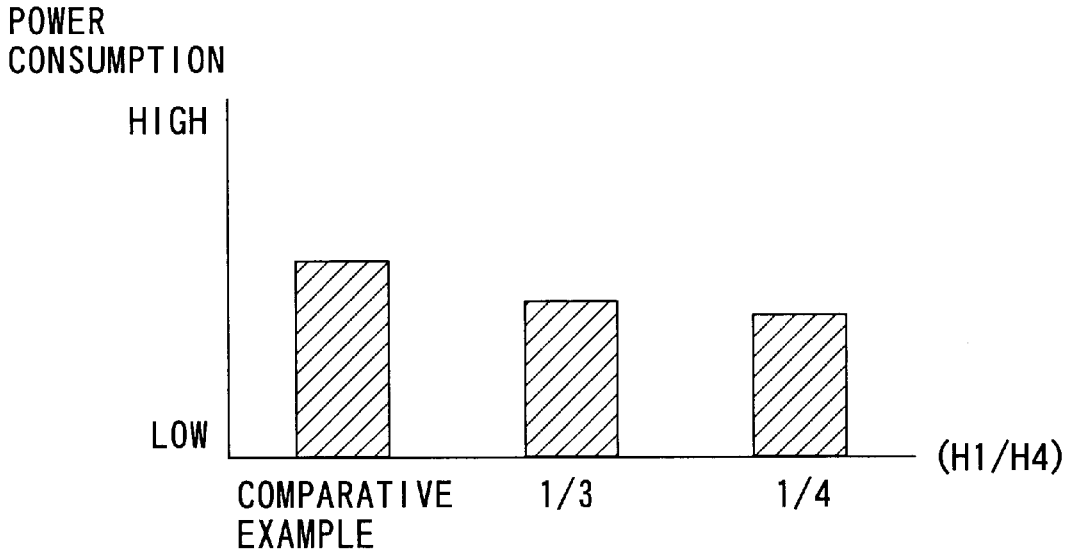
FIG. 3 is a diagram useful in explaining the relationship between a ratio H1/H4 between an effective height H1 of each shaft guide and a reference height H4 of the shaft guides and power consumption of an electromagnet.
Figure 4A:
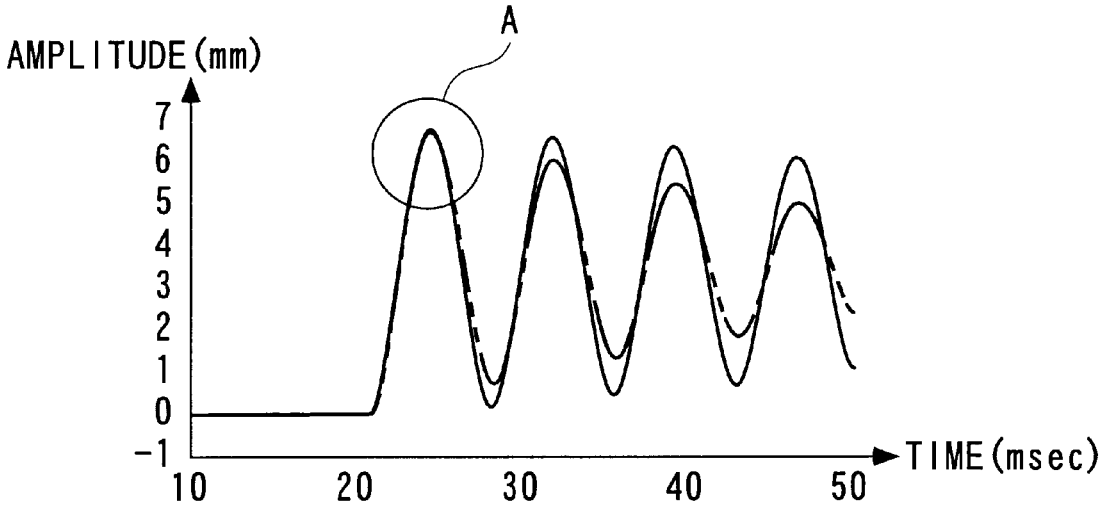
FIG. 4A is a diagram showing an example of a waveform of free vibration of an intake valve which occurs when the intake valve is released from a valve closed state.
Figure 4B:
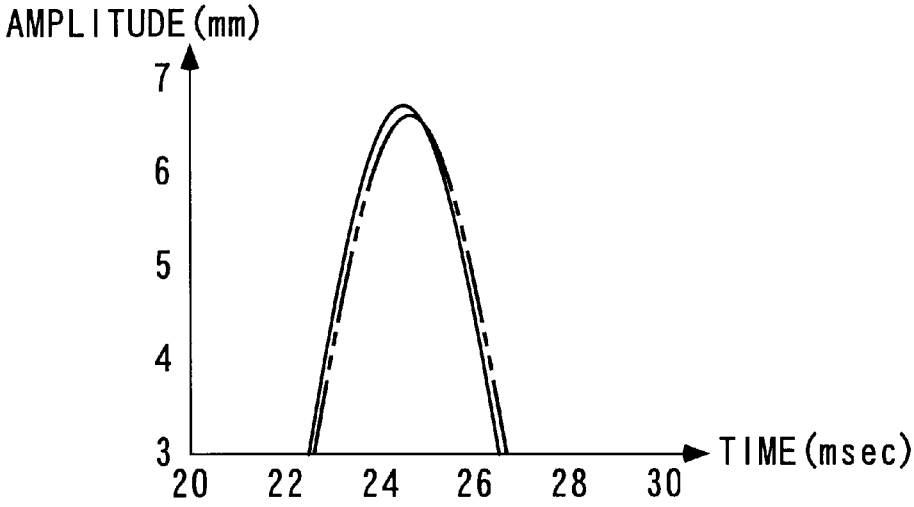
FIG. 4B shows a portion A in FIG. 4A on an enlarged scale.
Figure 5A:
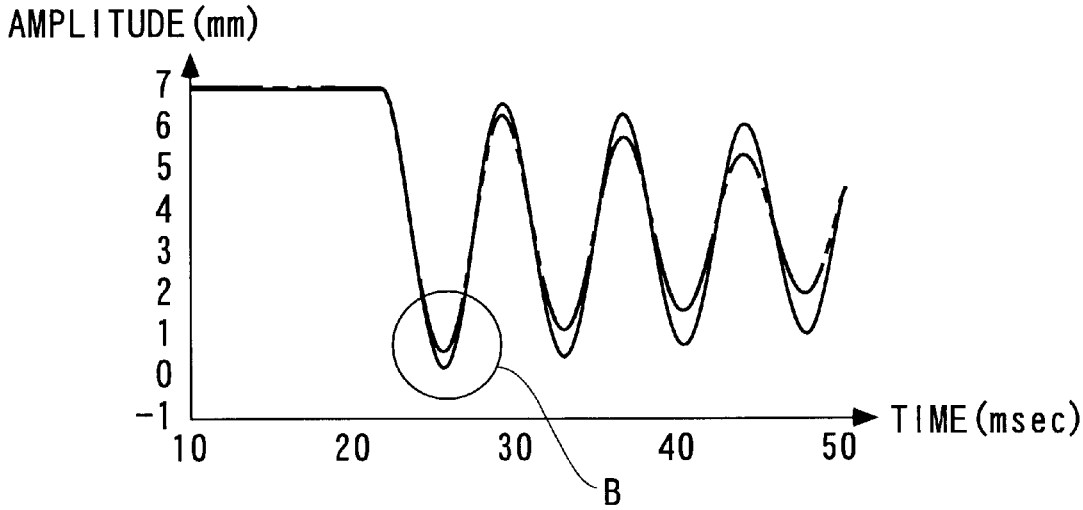
FIG. 5A is a diagram showing an example of a waveform of free vibration of the intake valve which occurs when the intake valve is released from a valve opened state.
Figure 5B:
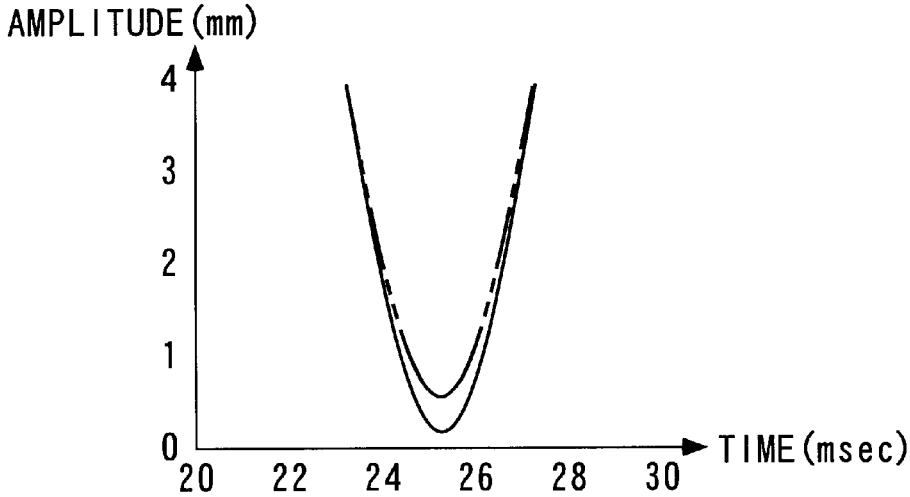
FIG. 5B shows a portion B in FIG. 5A on an enlarged scale.
Figure 6A:
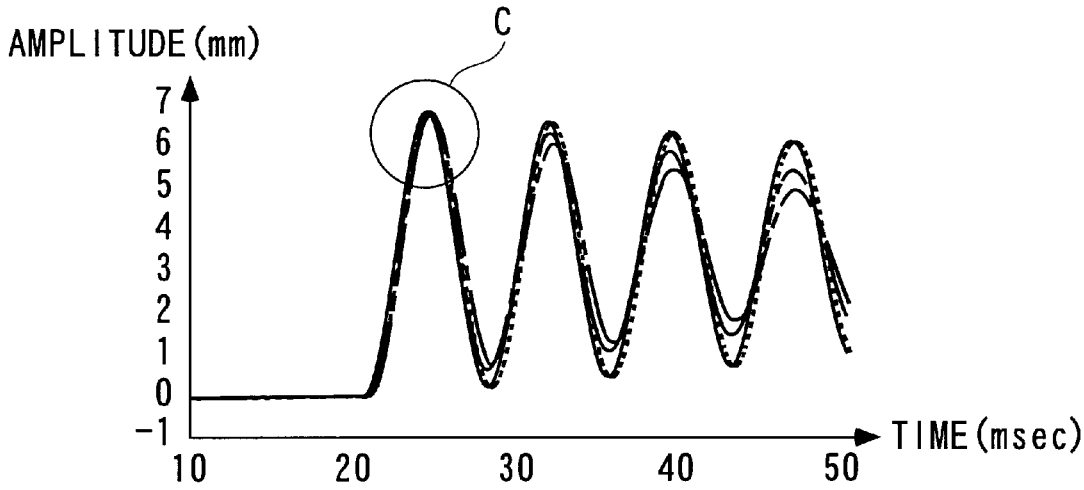
FIG. 6A is a diagram showing an example of variations in the waveform of the free vibration of the intake valve which occurs when the intake valve is released from the valve closed state.
Figure 6B:
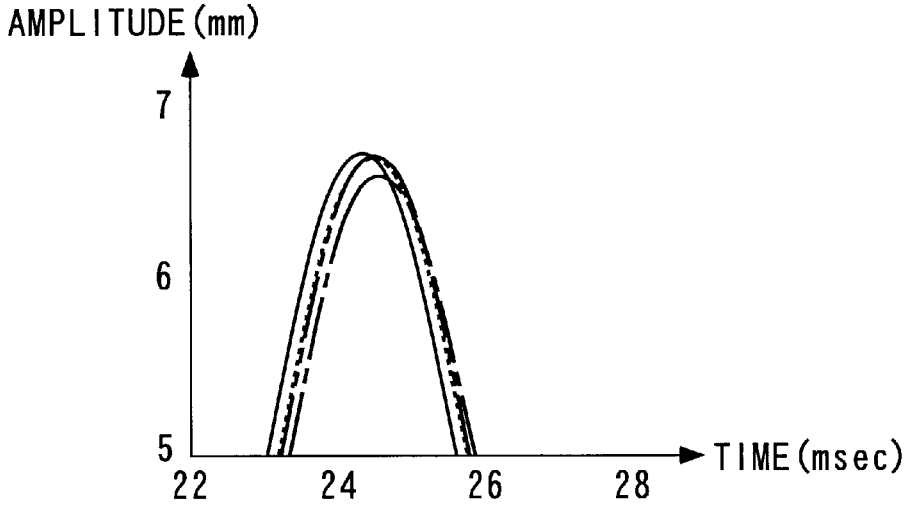
FIG. 6B shows a portion C in FIG. 6A on an enlarged scale.
Figure 7A:
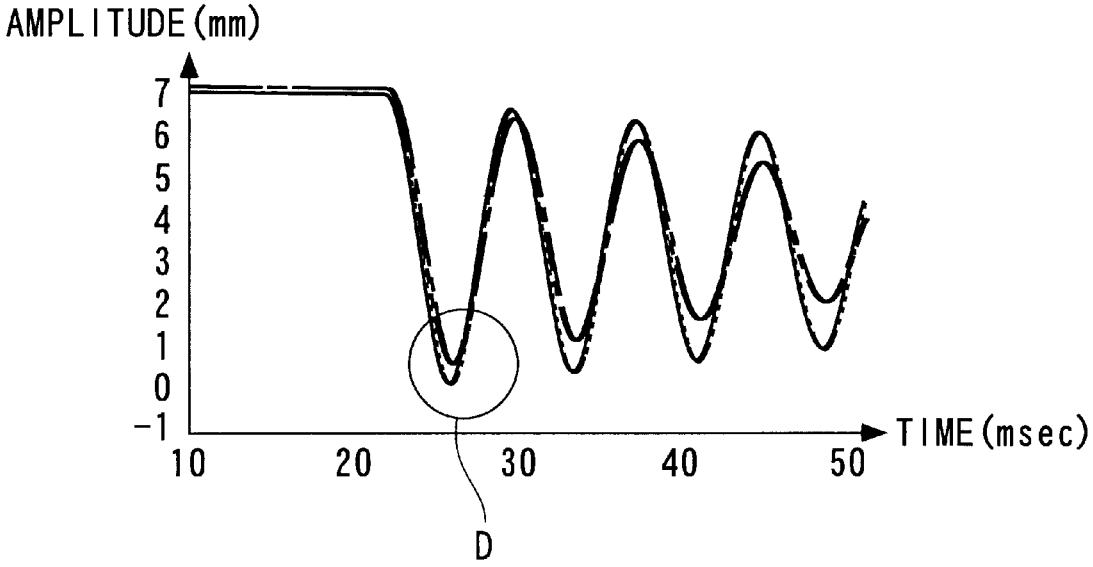
FIG. 7A is a diagram showing an example of variations in the waveform of the free vibration of the intake valve which occurs when the intake valve is released from the valve opened state.
Figure 7B:
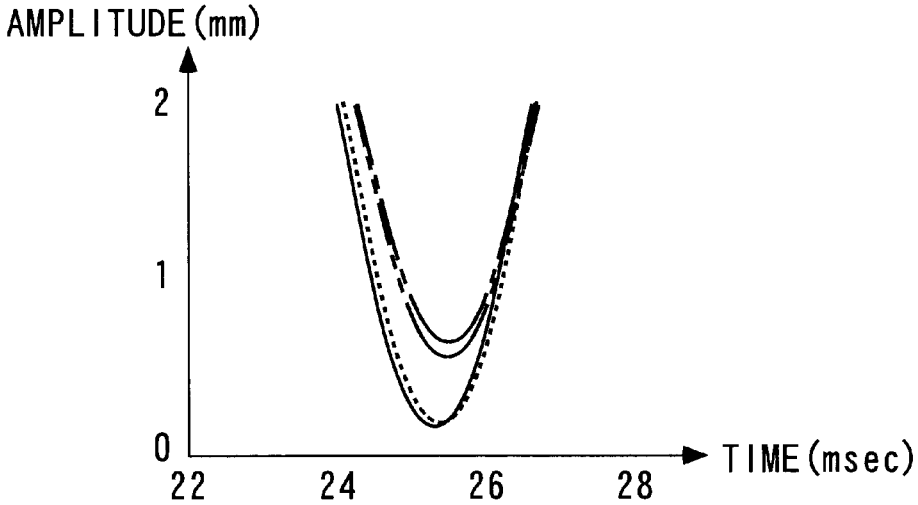
FIG. 7B shows a portion D in FIG. 7A on an enlarged scale.

In the following, description will be given, with reference to FIG. 3, of the relationship between the ratio H1/H4 of the effective height H1 of the shaft guide 13 (height of the guide hole portion 13*a*) to the reference height H4 and power consumption. The figure shows results of the measurement of power consumption of the electromagnets 10 carried out respectively on examples of the present embodiment (Examples) using two kinds of shaft guides 13 prepared under conditions that only the effective height H1 of each guide hole portion 13*a* is changed as a parameter and that the other dimensions of each shaft guide 13 and the yokes 11 are fixed. It should be noted that left-hand data in FIG. 3 shows a result of the measurement of power consumption of the electromagnets of a solenoid-type valve actuator using a single shaft guide having an entire inner hole thereof formed to have a uniform diameter and form a guide hole portion for guiding the shaft 7, for comparison. In this case, the height of the shaft guide is equal to the reference height H4. In the following, the solenoid-type valve actuator using the shaft guides having this construction will be referred to as Comparative Example.

As shown in the figure, according to the two Examples of the present embodiment, the power consumption of the electromagnets 10 is smaller than in the case of the Comparative Example. Further, in comparison between the two Examples of the present embodiment, the power consumption of the electromagnets 10 is further reduced as the ratio H1/H4 is smaller. This occurs due to the fact that as the ratio H1/H4 is smaller, the contact area between the shaft guide 13 and the shaft 7 is smaller, which reduces sliding resistance therebetween. Further, although data are not shown, experiments are carried out by operating solenoid-type valve actuators using many kinds of shaft guides 13 different in the ratio H1/H4 continuously over a long time period, measuring the power consumption as to each of the many kinds of the shaft guides 13 at the start and end of the operation, and calculating a rate of increase in the power consumption between the start and end of the operation. Results of the experiments proved that as the ratio H1/H4 is smaller, the rate of increase in the power consumption is higher, and that particularly in the range where the ratio H1/H4 is below ¼, the rate of increase becomes further higher. Therefore, it is preferred that the ratio H1/H4 is preset to the value of approximately ¼, as in the present embodiment, so as to ensure both reduction of sliding resistance between the shaft guides and the shaft and durability thereof.

Next, the operation of the intake valve 3 by the solenoid-type valve actuator 1 of the present embodiment will be described with reference to FIGS. 4A to 7B. FIGS. 4A, 4B and 5A, 5B show examples of waveforms of free vibration measured by allowing the intake valve 3 to freely vibrate by the urging forces of the respective coil springs 6, 6 at the time of the intake valve 3 being released from a valve closed state in which the intake valve 3 has been held by the upper electromagnet 10 and from a valve opened state in which the intake valve 3 has been held by the lower electromagnet 10. In the figures, results of the measurement carried out using the solenoid-type valve actuator 1 of the present embodiment (one of Examples in which the ratio H1/H4 is set to ¼) are shown by solid lines, while results of the measurement carried out using Comparative Example are shown by two-dot chain lines.

FIGS. 4A, 4B and 5A, 5B show that the amplitude of free vibration of the intake valve 3 is larger in the case of the present embodiment than in the case of Comparative Example. In other words, the results of the measurements also proved that the solenoid-type valve actuator 1 of the present embodiment makes it possible to reduce the sliding resistance to the shaft 7 to a larger degree, compared with Comparative Example. It should be noted that in the results of the measurements shown in the figures, the amplitude of free vibration of the intake valve 3 having been released from the closed state is slightly larger than that of free vibration of the intake valve 3 having been released from the opened state, because the neutral position of the armature 5 is slightly offset toward the lower electromagnet 10 as described hereinbefore and hence a stroke from the neutral position to the position for contact with the upper electromagnet 10 is longer, which causes larger reaction forces of the coil springs 6, 6 to act on the intake valve 3.

FIGS. 6A, 6B and 7A, 7B show waveforms which showed a maximum amplitude value and a minimum amplitude value, respectively, as typical ones among a plurality of waveforms each measured, similarly to the waveforms shown in FIGS. 4A, 4B and 5A, 5B, when the intake valve 3 is allowed to freely vibrate at the respective times of being released from the valve closed state and from the valve opened state. In the figures, data obtained as to the present embodiment when the maximum amplitude value was recorder are indicated by solid lines and data obtained as to same when the minimum amplitude value was recorded by broken lines, while corresponding data obtained as to Comparative Example are indicated by two-dot chain lines and one-dot chain lines. The figures show that the difference between the maximum amplitude value and the minimum amplitude value is smaller in the present embodiment than in Comparative Example. This means that the present embodiment makes it possible to reduce variations in the amplitude, thereby enhancing accuracy in the opening and closing control of the intake valve 3.

As described above, according to the solenoid-type valve actuator of the embodiment, since the two shaft guides 13, 13 are arranged vertically in a line, compared with Comparative Example in which the shaft is guided by the single shaft guide or conventional valve actuators in which a yoke is used for guiding a shaft, it is possible to make smaller the contact area between the shaft guides 13, 13 and the shaft 7 while maintaining the same total height (reference height H4) of the two shaft guides 13, 13 as that of the single shaft guide in Comparative Example or the yoke in the conventional ones. As a result, the shaft 7 can be supported in a radially stable fashion, which makes it possible to maintain the stability of operation of the intake valve 3. Further, since the sliding resistance exhibited against the operation of the intake valve 3 can be reduced, it is possible to improve the response of the intake valve 3 as well as to reduce power consumption of the electromagnets 10. In addition, it is possible to enhance accuracy in the opening and closing control of the intake valve 3. Moreover, compared with the prior art in which a guide hole is formed through a yoke of the electromagnet, the present embodiment can achieve the above advantageous effects by a more inexpensive and simple construction, i.e. simply by arranging the two shaft guides 13, 13 in a line in the direction of reciprocating motion of the intake valve 3.

Figure 8:
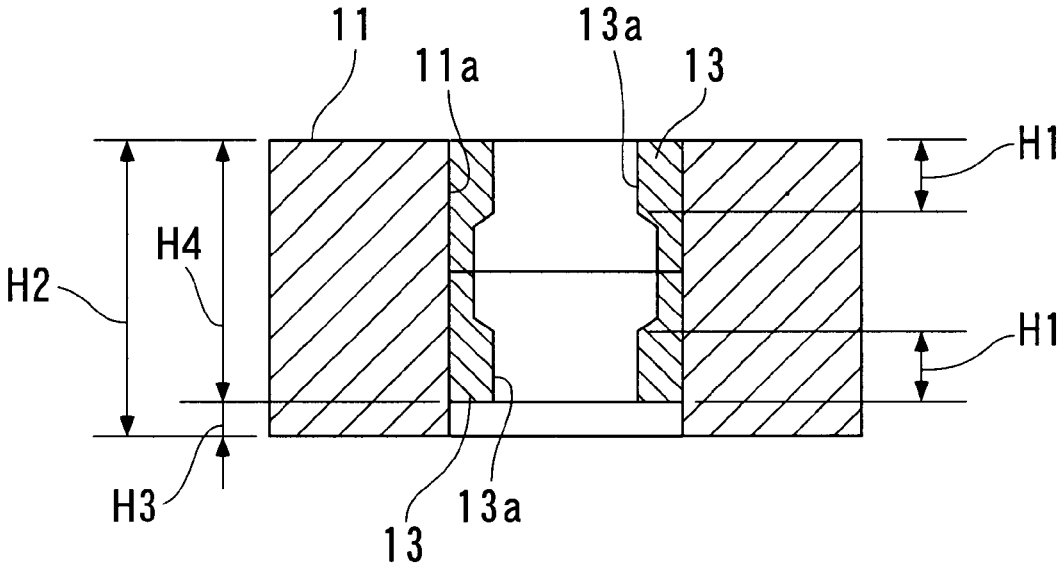
FIG. 8 is a cross-sectional view of a shaft guide according to a variation of the embodiment.

It goes without saying that the shape of each shaft guide 13 is not limited to that of the embodiment. For example, as shown in FIG. 8, the shaft guides 13 may be each formed to have a shape which allows the upper and lower shaft guides 13, 13 to be arranged in contact with each other. In this case, differently from the above embodiment, it is possible to properly position the shaft guides 13, 13 with ease, which facilitates assembly of the present valve actuator 1.

Further, although in the above embodiment, the solenoid-type valve actuator 1 of the invention is applied to the valve actuators for the intake valve and exhaust valve of the engine 2, this is not limitative, but the solenoid-type valve actuator 1 can be used as valve actuators for other valves of the engine. For example, it may be applied to a valve for opening and closing an EGR pipe or fuel injection valves.

It is further understood by those skilled in the art that the foregoing is a preferred embodiment of the invention, and that various changes and modifications may be made without departing from the spirit and scope thereof.

What is claimed is:

1. A solenoid-type valve actuator for an internal combustion engine, for electromagnetically opening and closing a valve, comprising, two electromagnets arranged in a manner opposed to each other with a space therebetween, an armature arranged between said two electromagnets, for reciprocating motion by energization and de-energization of said two electromagnets;

two shafts projecting from respective opposite sides of said armature and extending through said two electromagnets, respectively, one of said shafts being connected to the valve; and two shaft guides arranged in at least one of said two electromagnets in a line along a direction of the reciprocating motion of said armature, for guiding a reciprocating motion of at least one of said two shafts performed according to the reciprocating motion of said armature, at least one of said two shaft guides is formed with an inner contact surface for contact with at least one of said two shafts and an inner non-contact surface for non-contact with at least one of said two shafts.

2. A solenoid-type valve actuator according to claim 1, wherein said two shaft guides are arranged in a line along the direction of the reciprocating motion of said armature with a space provided therebetween.

3. A solenoid-type valve actuator according to claim 1, wherein said two shaft guides are each formed with said inner contact surface and said inner non-contact surface, and wherein a ratio of a length of each of said inner contact surfaces in the direction of the reciprocating motion of said armature to a total length of said two shaft guides in the direction of the reciprocating motion is preset to a value of approximately ¼.

4. A solenoid type valve actuator according to claim 1, wherein said at least one of said two shafts has a flange at one end thereof near said armature, and wherein one of said two shaft guides near said armature is formed with a space serving as an indentation for receiving said flange of said at least one of said two shafts.

5. A solenoid type valve actuator according to claim 1, wherein said two shaft guides are each formed with said inner contact surface and said inner non-contact surface, and wherein each of said inner contact surfaces is disposed at corresponding ends of at least one of said electromagnets, and each of said inner non-contact surfaces is disposed inside said inner contact surfaces.

6. A solenoid-type valve actuator according to claim 1, wherein at least one of said two shaft guides comprises a shaft guide formed of a non-magnetic material.

7. A solenoid-type valve actuator according to claim 6, wherein said two shaft guides are arranged in a line along the direction of the reciprocating motion of said armature with a space provided therebetween.

8. A solenoid-type valve actuator according to claim 6, wherein said two shaft guides are each formed with an inner contact surface and an inner non-contact surface, and wherein a ratio of a length of each contact surface in the direction of the reciprocating motion of said armature to a total length of said two shaft guides in the direction of the reciprocating motion is preset to a value of approximately ¼.

9. A solenoid type valve actuator according to claim 6, wherein said at least one of said two shafts has a flange at one end thereof near said armature, and wherein one of said two shaft guides near said armature is formed with a space serving as an indentation for receiving said flange of said at least one of said two shafts.

10. A solenoid type valve actuator according to claim 6, wherein said two shaft guides are each formed with an inner contact surface and an inner non-contact surface, and wherein each said inner contact surface is disposed at corresponding ends of at least one of said electromagnets, and each said inner non-contact surface is disposed inside each of said inner contact surfaces.

11. A solenoid-type valve actuator for an internal combustion engine, for electromagnetically opening and closing a valve, comprising, two electromagnets arranged in a manner opposed to each other with a space therebetween;

an armature arranged between said two electromagnets, for reciprocating motion by energization and de-energization of said two electromagnets;

two shafts projecting from respective opposite sides of said armature and extending through said two electromagnets, respectively, one of said shafts being connected to the valve; and two shaft guides arranged in at least one of said two electromagnets in a line along a direction of the reciprocating motion of said armature, for guiding a reciprocating motion of at least one of said two shafts performed according to the reciprocating motion of said armature, each of the shaft guides having a first inner diameter at a first end portion and a second inner diameter at a second end portion for guiding the reciprocating motion of at least one of said two shafts, wherein a ratio of a length of each said shaft guide portion corresponding to said first inner diameter in the direction of the reciprocating motion of said armature to a total length of said two shaft guides in the direction of the reciprocating motion is preset to a value of approximately ¼.

12. A solenoid-type valve actuator according to claim 11, wherein said two shaft guides are arranged in a line along the direction of the reciprocating motion of said armature with a space provided therebetween.

13. A solenoid type valve actuator according to claim 4, wherein said at least one of said two shafts has a flange at one end thereof near said armature, and wherein one of said two shaft guides near said armature is formed with a space serving as an indentation for receiving said flange of said at least one of said two shafts.

14. A solenoid type valve actuator according to claim 11, wherein said two shaft guides are each formed with said first inner diameter and said second inner diameter, and wherein each said first end portion of said two shaft guides is disposed at corresponding ends of at least one of said electromagnets.

15. A solenoid-type valve actuator for an internal combustion engine, for electromagnetically opening and closing a valve, comprising, two electromagnets arranged in a manner opposed to each other with a space therebetween;

an armature arranged between said two electromagnets, for reciprocating motion by energization and de-energization of said two electromagnets;

two shafts projecting from respective opposite sides of said armature and extending through said two electromagnets, respectively, one of said shafts being connected to the valve; and two shaft guides arranged in at least one of said two electromagnets in a line along a direction of the reciprocating motion of said armature, each of the guides having a through hole for guiding a reciprocating motion of at least one of said two shafts performed according to the reciprocating motion of said armature, the through hole of at least one of the shaft guides includes an inner wall portion having a first radial surface, a second radial surface, and a transitional surface coupling the first surface and the second surface for guiding the reciprocating motion of at least one of said two shafts.

16. A solenoid-type valve actuator according to claim 15, wherein said two shaft guides are arranged in a line along the direction of the reciprocating motion of said armature with a space provided therebetween.

17. A solenoid-type valve actuator according to claim 15, wherein said two shaft guides are each formed with said first radial surface said second radial surface, and said transitional surface, wherein a ratio of a length of each of said first radial surfaces in the direction of the reciprocating motion of said armature to a total length of said two shaft guides in the direction of the reciprocating motion is preset to a value of approximately ¼.

18. A solenoid type valve actuator according to claim 15, wherein said at least one of said two shafts has a flange at one end thereof near said armature, and wherein one of said two shaft guides near said armature is formed with a space serving as an indentation for receiving said flange of said at least one of said two shafts.

19. A solenoid type valve actuator according to claim 15, wherein said two shaft guides are each formed with said first radial surface, said second radial surface, and said transitional surface, wherein each said first radial surface is disposed at corresponding ends of at least one of said electromagnets, and each said second radial surface is disposed inside each of said first radial surfaces.

* * * * *